US009198242B2

(12) United States Patent
Chu et al.

(10) Patent No.: US 9,198,242 B2
(45) Date of Patent: Nov. 24, 2015

(54) APPARATUS FOR DRIVING LEDS USING HIGH VOLTAGE

(71) Applicant: VastView Technology Inc., Hsinchu County (TW)

(72) Inventors: Hung-Chi Chu, Hsinchu County (TW); YuhRen Shen, Hsinchu County (TW)

(73) Assignee: VastView Technology Inc., Hsinchu County (TW)

( * ) Notice: Subject to any disclaimer, the term of this patent is extended or adjusted under 35 U.S.C. 154(b) by 128 days.

(21) Appl. No.: 14/174,900

(22) Filed: Feb. 7, 2014

(65) Prior Publication Data

US 2015/0230298 A1 Aug. 13, 2015

(51) Int. Cl.
*H05B 33/08* (2006.01)

(52) U.S. Cl.
CPC ..... *H05B 33/0815* (2013.01)

(58) Field of Classification Search
CPC ..... H05B 33/00; H05B 33/0815
USPC ..... 315/185 R, 193, 291
See application file for complete search history.

(56) References Cited

U.S. PATENT DOCUMENTS

| | | | | |
|---|---|---|---|---|
| 6,989,807 | B2 | 1/2006 | Chiang | |
| 8,324,840 | B2 | 12/2012 | Shteynberg et al. | |
| 2011/0089844 | A1 | 4/2011 | Grajcar | |
| 2012/0056559 | A1 | 3/2012 | Fu et al. | |
| 2012/0217887 | A1 | 8/2012 | Kang et al. | |
| 2013/0093340 | A1 * | 4/2013 | Horino et al. | 315/193 |
| 2014/0042907 | A1 * | 2/2014 | Cheng et al. | 315/122 |
| 2014/0077709 | A1 * | 3/2014 | Zhang et al. | 315/188 |
| 2014/0077712 | A1 * | 3/2014 | Cheng et al. | 315/193 |

* cited by examiner

*Primary Examiner* — Thuy Vinh Tran
*Assistant Examiner* — Pedro C Fernandez
(74) *Attorney, Agent, or Firm* — Lin & Associates Intellectual Property, Inc.

(57) ABSTRACT

An apparatus for driving LEDs using high voltage includes a plurality of LEDs divided into a plurality of LED segments connected in series with a switching voltage detector and a current limiting device. Each of the plurality of LED segments is connected in parallel with a switching device. A high input voltage supplies power to the apparatus. The switching voltage detector generates a first mode change signal when the input voltage increases and a second mode change signal when the input voltage decreases. A switch controller receives the two mode change signals and generates a plurality of switching control signals to respectively control the switching devices of the plurality of LED segments.

20 Claims, 13 Drawing Sheets

APPARATUS FOR DRIVING LEDS USING HIGH VOLTAGE

BACKGROUND OF THE INVENTION

1. Field of the Invention

The present invention relates generally to light emitting diode (LED) based lighting apparatus, and more particularly to an apparatus for driving an LED based lighting apparatus using high input voltage.

2. Description of Related Arts

LEDs are semiconductor-based light sources often employed in low-power instrumentation and appliance applications for indication purposes in the past. The application of LEDs in various lighting units has also become more and more popular. For example, high brightness LEDs have been widely used for traffic lights, vehicle indicating lights, and braking lights. In recent years, high voltage LED-based lighting apparatus have been developed to replace the conventional incandescent and fluorescent lamps.

An LED has an I-V characteristic curve similar to an ordinary diode. When the voltage applied to the LED is less than a forward voltage, only very small current flows through the LED. When the voltage exceeds the forward voltage, the current increases sharply. The output luminous intensity of an LED light is approximately proportional to the LED current for most operating values of the LED current except for the high current value. A typical driving device for an LED light is designed to provide a constant current for stabilizing light emitted from the LED and extending the life of the LED.

In order to increase the brightness of an LED light, a number of LEDs are usually connected in series to form an LED-based lighting string and a number of LED-based lighting strings may further be connected in series to form a lighting apparatus. The operating voltage required by each lighting string typically is related to the forward voltage of the LEDs in each lighting string, how many LEDs are employed for each of the lighting strings and how they are interconnected, and how the respective lighting strings are organized and arranged to receive power from a power source.

Accordingly, in many applications, some type of voltage conversion device is required in order to provide a generally lower operating voltage to one or more LED-based lighting strings from more commonly available higher power supply voltages. The need of a voltage conversion device reduces the efficiency, costs more and also makes it difficult to miniaturize an LED-based lighting device.

In order to increase the efficiency and miniaturize the LED-based lighting apparatus, many techniques have been developed for the apparatus to use operating voltages such as 120V AC or 240V AC without requiring a voltage conversion device. In general, the LEDs in the apparatus are divided into a number of LED segments that can be selectively turned on or off by associated switches or current sources, and a controller is used to control the switches or current sources as the operating AC voltage increases or decreases.

In the prior arts, most of the high voltage LED-based lighting apparatus rely on the detection of the voltage level of the input AC voltage or the current flowing through the apparatus so as to control the switches or current sources to turn on or off selected LED segments. For example, U.S. Pat. Nos. 6,989,807 and 8,324,840 and U.S. Pat. Publication No. 2011/0089844 use a global controller that detects the input voltage level for controlling the current sources or switches connected to the LEDs. U.S. Pat. Publication No. 2012/0056559 and 2012/0217887 use a global controller to control current clamping units or switches according to local current sensing data.

As more and more LED-based lighting apparatus are used in high brightness lighting equipment with high input voltage, there is a strong need to design methods and apparatus that can drive and connect the LED-based lighting strings intelligently and efficiently to increase the utilization of the LEDs, reduce power loss and provide stable and high brightness by using the readily available AC source from a wall power unit.

SUMMARY OF THE INVENTION

The present invention has been made to provide an apparatus that can efficiently drive an LED string using high input voltage. In accordance with the present invention, the apparatus comprises a plurality of LEDs divided into a plurality of LED segments connected in series with a switching voltage detector and a current limiting device.

Each LED segment is connected in parallel with a switching device that can be separately controlled by a switch controller that generates binary or non-binary codes to selectively turn on or off the switching device so that the LED-based lighting apparatus can change its operation mode as the voltage level of the input voltage varies.

According to a first preferred embodiment of the present invention, the switching voltage detector is connected to the trailing LED segment and the current limiting device is connected between the switching voltage detector and ground. The switching voltage detector comprises a delta voltage detector that detects the input voltage variation and a mode change signal generator that generates mode change signals when the input voltage varies.

In the first preferred embodiment, the delta voltage detector includes three N-type voltage controlled current limiting devices. Each N-type voltage controlled current limiting device has three terminals. In a first implementation of the delta voltage detector, one or more LEDs are connected between the first terminals of the first and second voltage controlled current limiting devices as well as the first terminals of the second and third voltage controlled current limiting devices.

The second terminal of each N-type voltage controlled current limiting device is connected to a bias voltage and the third terminal is connected to a common node through a current sensing device. The mode change signal generator has two comparators connected to the current sensing devices and a control signal generator receives the outputs of the two comparators and generates two mode change signals according to the voltage level of the input voltage.

In a second implementation of the delta voltage detector, the first terminal of each N-type voltage controlled current limiting device is connected to one end of a respective current sensing device, and one or more LEDs are connected between the other ends of two adjacent current sensing devices. The second terminal of each N-type voltage controlled current limiting device is connected to a bias voltage and the third terminals of the three N-type voltage controlled current limiting devices are connected to a common node.

Three differential amplifiers are respectively connected across the three current sensing devices. The mode change signal generator has two comparators connected to the outputs of the three differential amplifiers and a control signal generator receives the outputs of the two comparators and generates two mode change signals according to the voltage level of the input voltage.

According to a second preferred embodiment of the present invention, the switching voltage detector is connected to the leading LED segment and the current limiting device is connected between the input voltage and the switching voltage detector. The switching voltage detector comprises a delta voltage detector that detects the input voltage variation and a mode change signal generator that generates mode change signals when the input voltage varies.

In the second preferred embodiment, the delta voltage detector includes three P-type voltage controlled current limiting devices. In a first implementation of the delta voltage detector, each P-type voltage controlled current limiting device has three terminals. One or more LEDs are connected between the first terminals of the first and second voltage controlled current limiting devices as well as the first terminals of the second and third voltage controlled current limiting devices.

A voltage source is connected between the input voltage and the second terminal of each P-type voltage controlled current limiting device. The third terminal of each P-type voltage controlled current limiting device is connected to a common node through a current sensing device. The mode change signal generator has two comparators connected to the current sensing devices and a control signal generator receives the outputs of the two comparators and generates two mode change signals according to the voltage level of the input voltage.

In a second implementation of the delta voltage detector in the second preferred embodiment, the third terminal of each P-type voltage controlled current limiting device is connected directly to a common node and the second terminal is connected to the input voltage through a respective voltage source. The first terminal of each P-type voltage controlled current limiting device is connected to one end of a respective current sensing device, and one or more LEDs are connected between the other ends of two adjacent current sensing devices.

Similar to the second implementation of the first preferred embodiment, there are three differential amplifiers respectively connected across the three current sensing devices in the second implementation of the second preferred embodiment. The mode change signal generator has two comparators connected to the outputs of the three differential amplifiers and a control signal generator receives the outputs of the two comparators and generates two mode change signals according to the voltage level of the input voltage.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
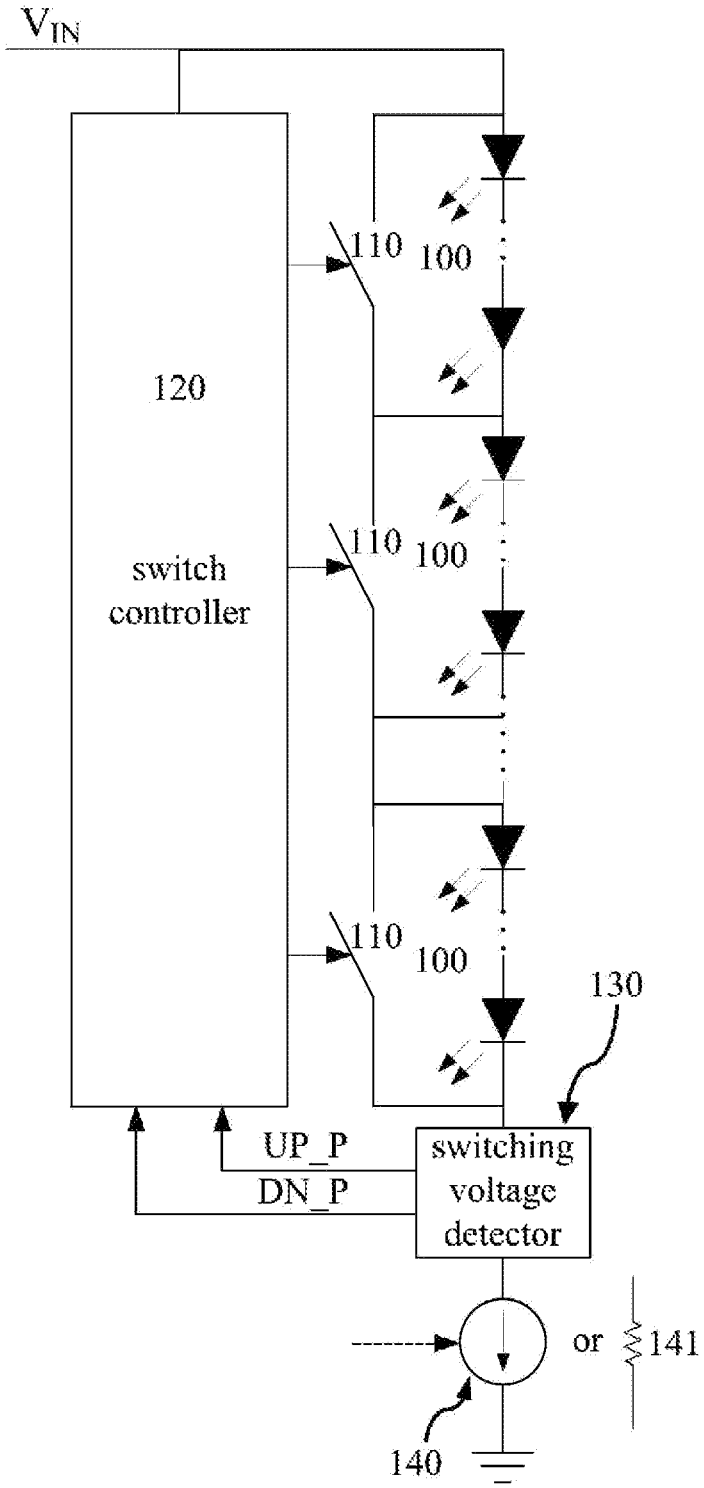
FIG. 1 shows a block diagram of an apparatus for driving LEDs using high voltage according to a first preferred embodiment of the present invention.

The accompanying drawings are included to provide a further understanding of the invention, and are incorporated in and constitute a part of this specification. The drawing illustrates embodiments of the invention and, together with the description, serves to explain the principles of the invention.

FIG. 1 shows a block diagram of an apparatus for driving LEDs using high voltage according to a first preferred embodiment of the present invention. In the embodiment, the apparatus comprises a plurality of LEDs connected in series. The plurality of LEDs is divided into a plurality of LED segments 100. Each LED segment 100 has a positive end and a negative end connected respectively to the negative end of its preceding LED segment and the positive end of its following LED segment.

As can be seen in FIG. 1, each LED segment 100 has a switching device 110 connected in parallel with the LED segment 100. A switch controller 120 provides a plurality of switching signals to control the switching devices 110. The negative end of the trailing LED segment is connected to a switching voltage detector 130. A current limiting device 140 is connected between the switching voltage detector 130 and ground. The current limiting device 140 may be replaced by a resistor 141.

An input high voltage $V_{IN}$ is connected to the positive end of the leading LED segment as well as the switch controller 120 to supply the voltage to the apparatus for driving the LEDs. The switching voltage detector 130 detects the voltage level that varies with the input voltage $V_{IN}$ and generates two mode change signals UP_P and DN_P to control the switch controller 120. As the input voltage $V_{IN}$ increases, the mode change signal UP_P generates a series of mode change pulses to change the state of the switch controller 120. Similarly, as the input voltage $V_{IN}$ decreases, the mode change signal DN_P generates a series of mode change pulses to change the state of the switch controller 120.

Figure 2:
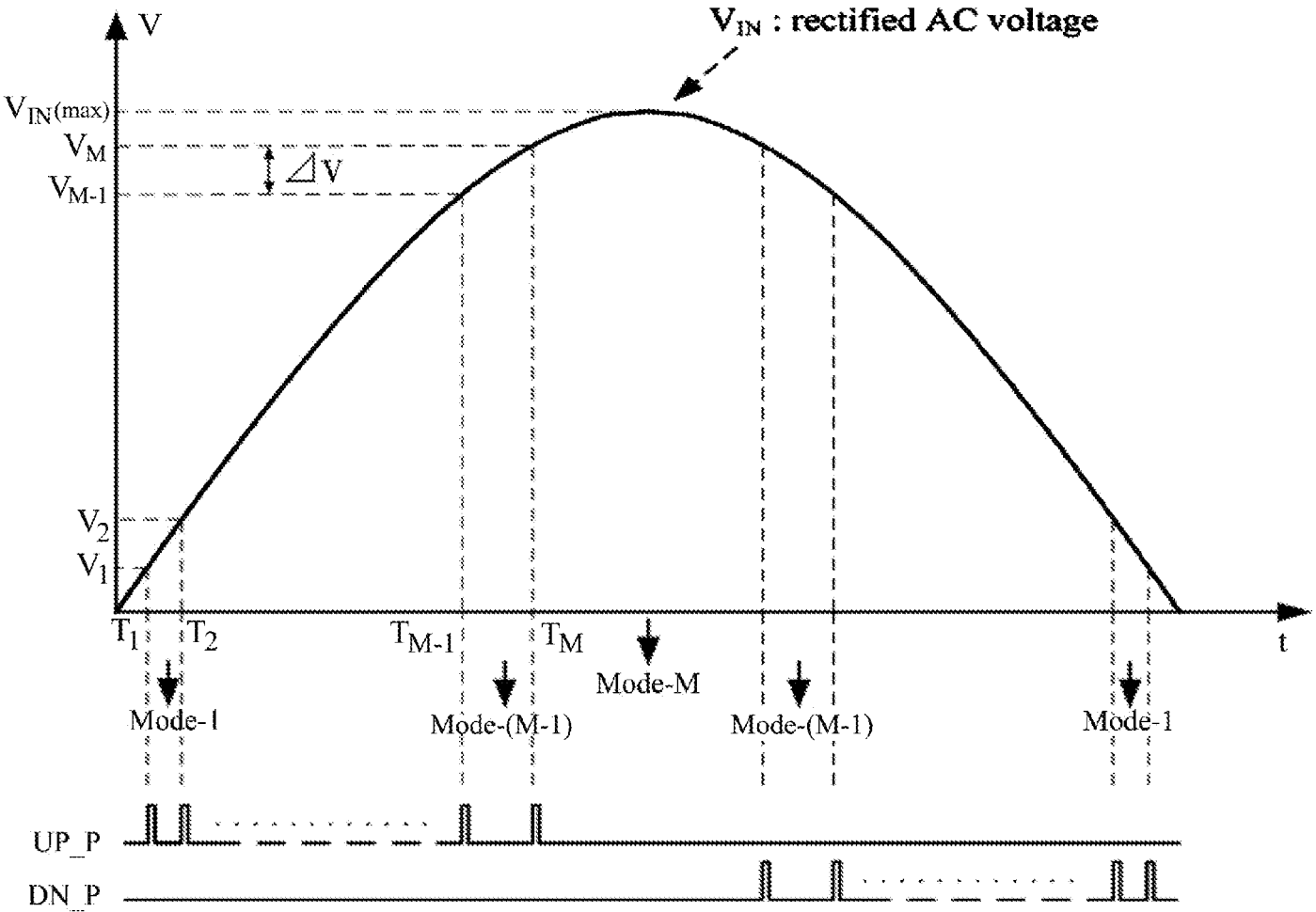
FIG. 2 shows the voltage levels of input voltage $V_{IN}$ for operating an LED-based lighting apparatus in M different operation modes using a rectified AC voltage source according to the present invention.

FIG. 2 shows the voltage levels of the input voltage $V_{IN}$ for operating an LED-based lighting apparatus in M different operation modes controlled by the two mode change signals UP_P and DN_P according to the present invention. $V_{IN}$ is a rectified AC voltage and each operation mode has a different number of LEDs connected in series. The two mode change signals UP_P and DN_P trigger the switch controller 120 to change its state for the LED-based lighting apparatus to operate in a different mode.

As shown in FIG. 2, the LED-based lighting apparatus operates in Mode-i between time $T_i$ and $T_{i+1}$ as the voltage level of the input voltage $V_{IN}$ increases between $V_i$ and $V_{i+1}$. As the rectified AC voltage reaches the maximum level, i.e., $V_{IN(max)}$, the voltage level starts decreasing. The LED-based lighting apparatus operates in Mode-M while the voltage level is between $V_M$ and $V_{IN(max)}$, and switches to operate in Mode-i when the voltage drops between $V_i$ and $V_{i+1}$. The difference between voltage $V_i$ and $V_{i+1}$ is the mode differential voltage ΔV.

Figure 3:
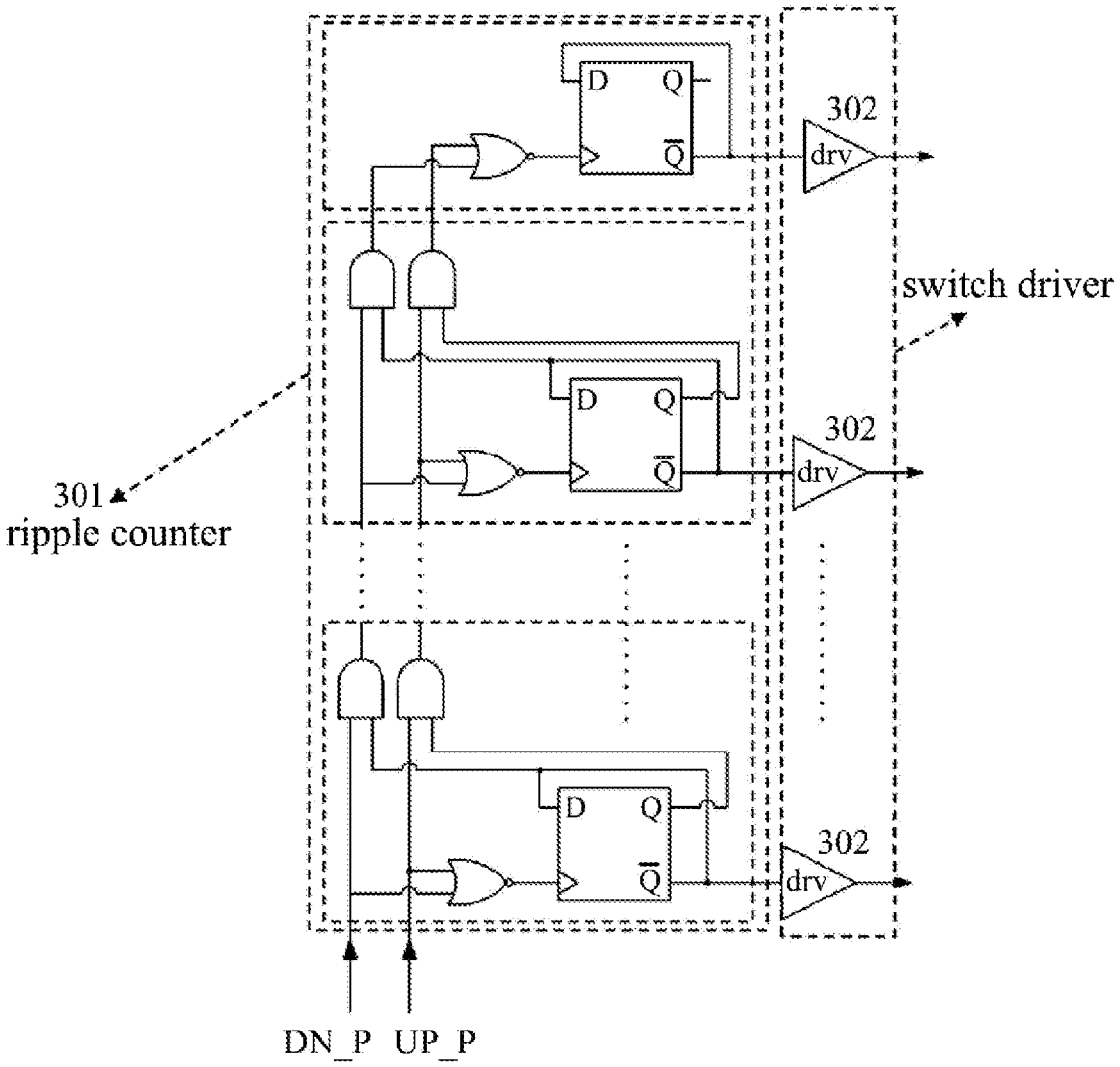
FIG. 3 shows an example of the switch controller comprising a ripple counter for generating binary codes.

FIG. 3 shows an example of the switch controller 120 for the first preferred embodiment of the present invention. In this example, the switch controller 120 comprises a ripple counter 301 that generates binary codes. The outputs of the ripple counter 301 are connected to a plurality of switch drivers 302 to drive the plurality of switching devices 110 shown in FIG. 1. Therefore, the LED-based lighting apparatus of FIG. 1 changes operation modes according to the binary codes generated by the ripple counter 301.

Figure 4:
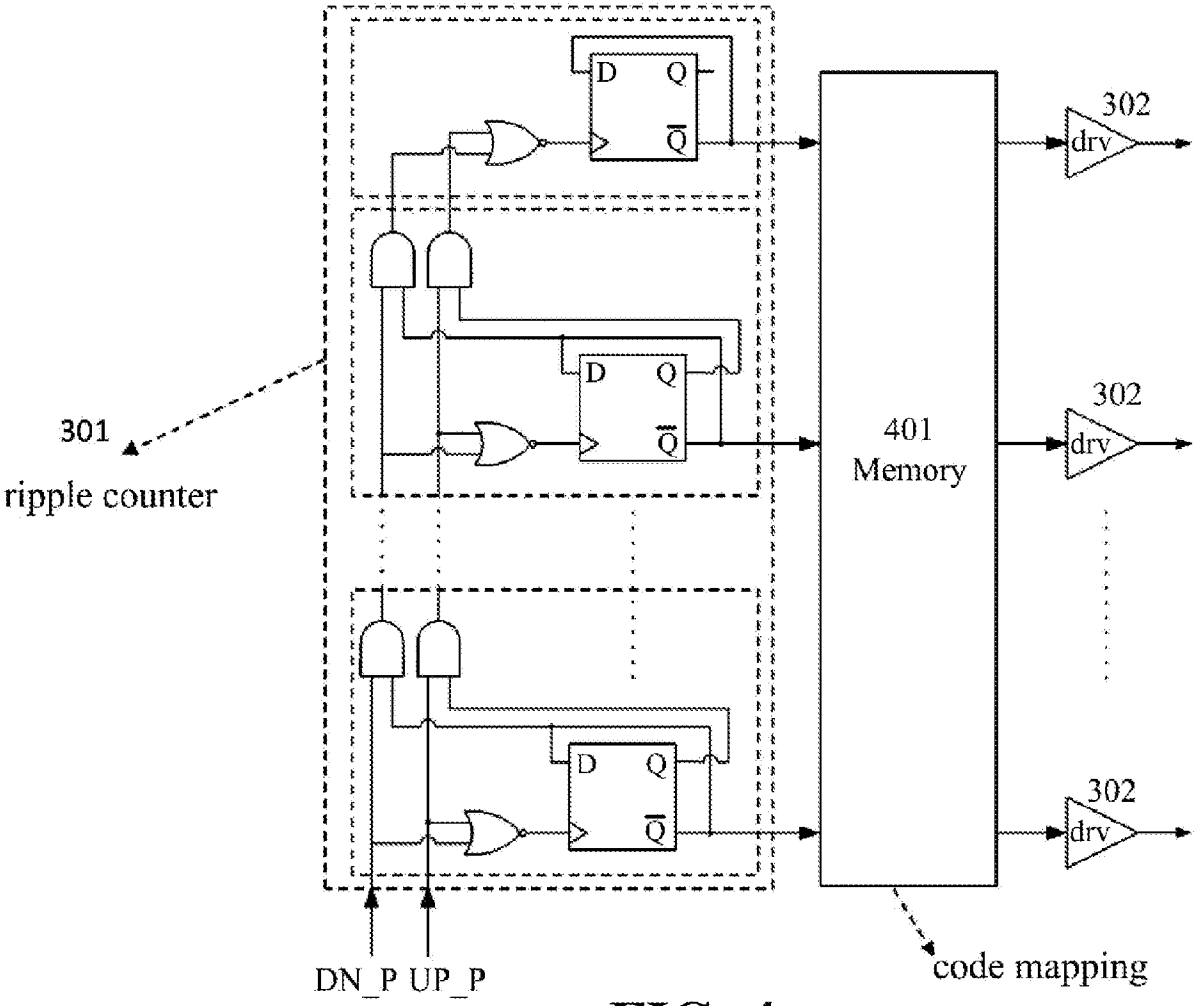
FIG. 4 shows another example of the switch controller comprising a ripple counter for generating binary codes and a memory device for mapping the binary codes to non-binary codes.

FIG. 4 shows another example of the switch controller 120 for the first preferred embodiment of the present invention. As can be seen from FIG. 4, a memory device 401 is connected to the outputs of the ripple counter 301 so as to map the binary codes generated by the ripple counter 301 to non-binary codes before they are connected to the plurality of switch drivers 302. As a result, the LED-based lighting apparatus of FIG. 1 can change operation modes according to the non-binary codes programmed by the code mapping stored in the memory device 401.

Figure 5A:
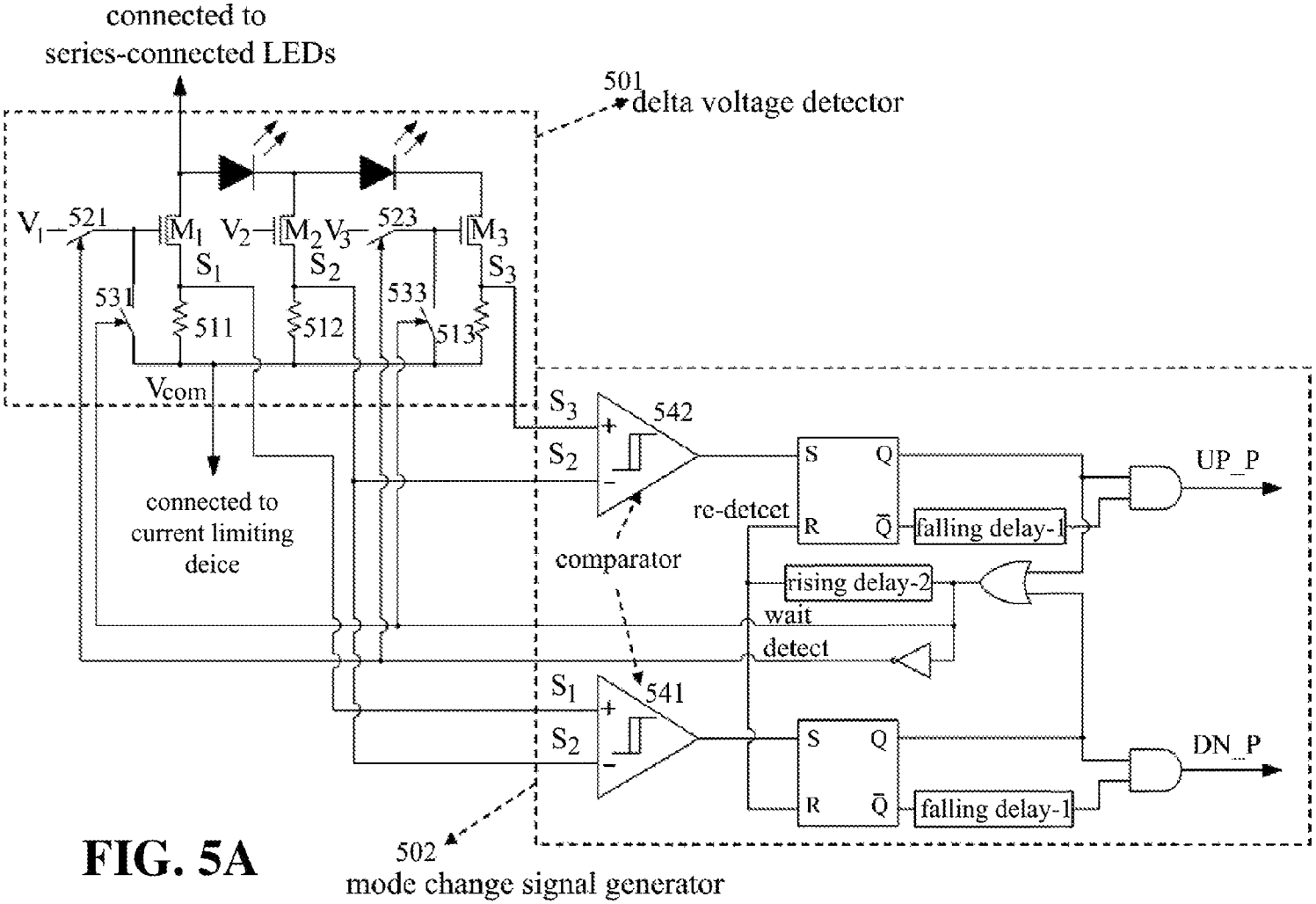
FIG. 5A shows the block diagram of a first implementation of the switching voltage detector in the first preferred embodiment.

According to the present invention, the switching voltage detector 130 comprises a delta voltage detector 501 and a mode change signal generator 502 as shown in a first implementation illustrated in FIG. 5A. The delta voltage detector 501 includes three N-type voltage controlled current limiting devices $M_1$, $M_2$ and $M_3$. Each of the N-type voltage controlled current limiting devices has three terminals. One or more LEDs are connected in series between the first terminals of $M_1$ and $M_2$. Diodes with similar I-V characteristics can also be used to replace the LEDs connected between the first terminals. Similarly, one or more LEDs are connected in series between the first terminals of $M_2$ and $M_3$.

In accordance with the present invention, the N-type three-terminal voltage controlled current limiting device can be implemented with various semiconductor devices. Although FIG. 5A shows three N-channel Metal Oxide Semiconductor (NMOS) field effect transistors, NPN Bipolar Junction Transistor (BJT) and N-channel Insulated Gate Bipolar Transistor (IGBT) can also be used as the N-type voltage controlled current limiting devices.

Figure 6:
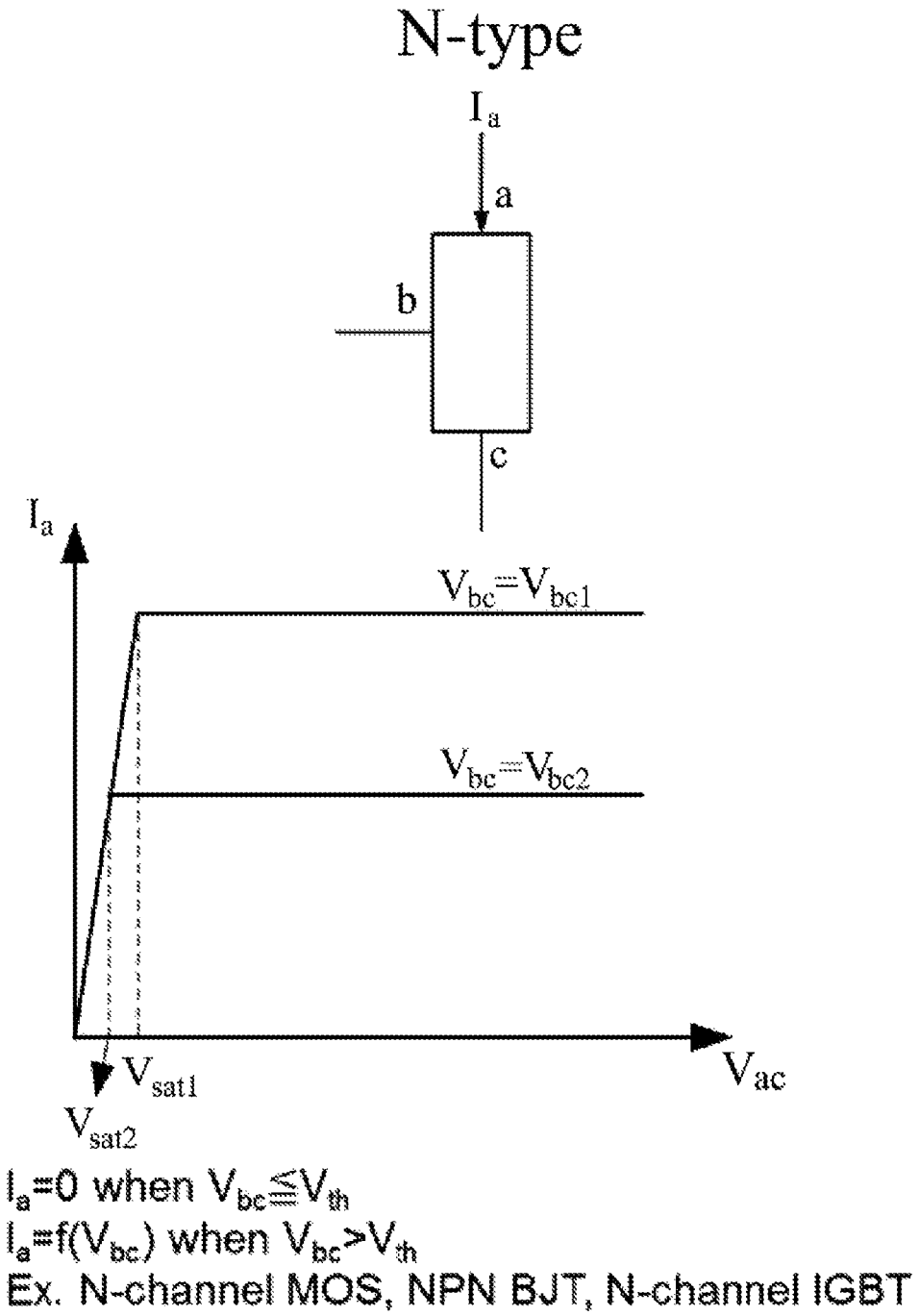
FIG. 6 shows the I-V characteristics of the N-type three-terminal voltage controlled current limiting device used in the delta voltage detector of the switching voltage detector in the first preferred embodiment.

FIG. 6 shows the I-V characteristics of the N-type three-terminal voltage controlled current limiting device according to the present invention. When the voltage $V_{bc}$ across the second and third terminals (terminals b and c) is less than or equal to the threshold voltage $V_{th}$ of the N-type three-terminal voltage controlled current limiting device, the current limiting device is cut off and the current $I_a$ flowing through the current limiting device is zero.

When the voltage $V_{bc}$ is greater than the threshold voltage $V_{th}$, and the voltage $V_{ac}$ across the first and third terminals (terminals a and c) is less than a saturation voltage $V_{sat}$ of the N-type three-terminal voltage controlled current limiting device, the current limiting device behaves like a resistor. In other words, $I_a$ is linearly proportional to $V_{ac}$.

As can be seen from FIG. 6, when the voltage $V_{bc}$ is greater than the threshold voltage $V_{th}$, and the voltage $V_{ac}$ across terminals a and c is greater than the saturation voltage $V_{sat}$, the N-type three-terminal voltage controlled current limiting device becomes a constant current source and $I_a$ is a function of $V_{bc}$, i.e. $I_a=f(V_{bc})$. It can also be noted that the saturation voltage $V_{sat}$ is proportional to $V_{bc}$.

As shown in FIG. 5A, the second terminals of the three N-type voltage controlled current limiting devices are connected to three bias voltages $V_1$, $V_2$ and $V_3$ respectively. The preferred bias voltages are $V_1<V_2<V_3$ when $M_1$, $M_2$ and $M_3$ have identical characteristics. The third terminals of $M_1$, $M_2$ and $M_3$ are connected to a common node through three respective current sensing devices 511, 512 and 513. It should be noted that the connection to the bias voltages $V_1$ and $V_3$ for $M_1$ and $M_3$ are controlled by the bias voltage switching devices 521 and 523 respectively.

In the delta voltage detector 501, the current sensing devices serve to determine if the operation mode of the LED-based lighting apparatus has to be changed based on the voltage level of the input voltage $V_{IN}$. When only $M_2$ has a current flowing through, no switching control is needed and the operation mode stays the same.

When the current flowing through $M_3$ is greater than $M_2$, it indicates that the input voltage $V_{IN}$ has increased to the level that more LEDs have to be connected in series to withstand the high voltage. Therefore, a mode change pulse should be generated in the mode change signal UP_P by the mode change signal generator 502 to change the operation mode of the LED-based lighting apparatus. In addition, a wait signal is also generated by the mode change signal generator 502 to short the by-pass switching device 533 so that no current flows through $M_3$ until all the desired segments of LEDs have been connected in series after the operation mode changes, and only $M_2$ has a current flowing through.

To the contrary, when the current flowing through $M_1$ is greater than $M_2$, it indicates that the input voltage $V_{IN}$ has decreased to the level that less LEDs should be connected in series. Therefore, a mode change pulse should be generated in the mode change signal DN_P by the mode change signal generator 502 to change the operation mode of the LED-based lighting apparatus.

A wait signal is also generated by the mode change signal generator 502 to short the by-pass switching device 531 so that no current flows through $M_1$ until all the desired segments of LEDs have been connected in series after the operation mode changes, and only $M_2$ has a current flowing through. It should be noted that the voltage level $V_{com}$ at the common node changes according to the input voltage $V_{IN}$.

As mentioned earlier, the bias voltages $V_1$ and $V_3$ for $M_1$ and $M_3$ are controlled by the bias voltage switching devices 521 and 523 respectively. As can be seen in FIG. 5A, a detect signal is generated from the mode change signal generator 502 to connect the bias voltages $V_1$ and $V_3$ for $M_1$ and $M_3$ after all the desired segments of LEDs have been connected in series when an operation mode is changed and it is necessary to detect the variation of the input voltage level again.

In the mode change signal generator 502, a first comparator 541 has two inputs respectively connected to the current sensing devices 511 and 512. A second comparator 542 has two inputs respectively connected to the current sensing devices 513 and 512. As shown in FIG. 5A, the mode change signal generator 502 further includes a control signal generator formed by two RS flip-flops, three delay circuits and a few logic gates.

Figure 7:
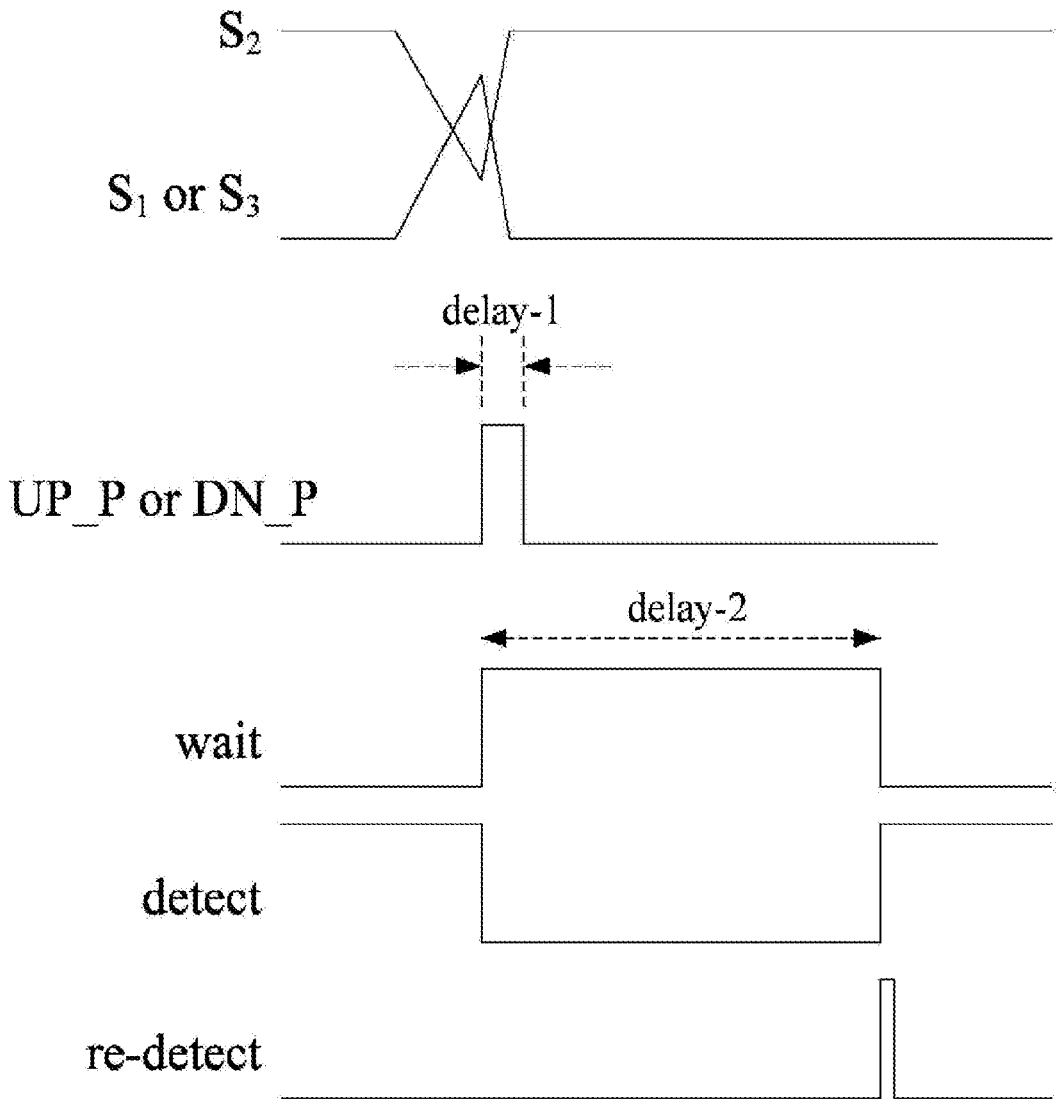
FIG. 7 illustrates the signal waveforms for various signals in the mode change signal generator of the first preferred embodiment.

The control signal generator receives the outputs of the two comparators and generates the wait signal, detect signal, and the two mode change signals UP_P and DN_P. FIG. 7 illustrates the signal waveforms for various signals in the mode change signal generator 502. It can be seen from FIG. 5A that in the delta voltage detector 501, the first terminal of $M_1$ is connected to the negative end of the trailing LED segment, and the common node $V_{com}$ is connected to the current limiting device 140.

Figure 5B:
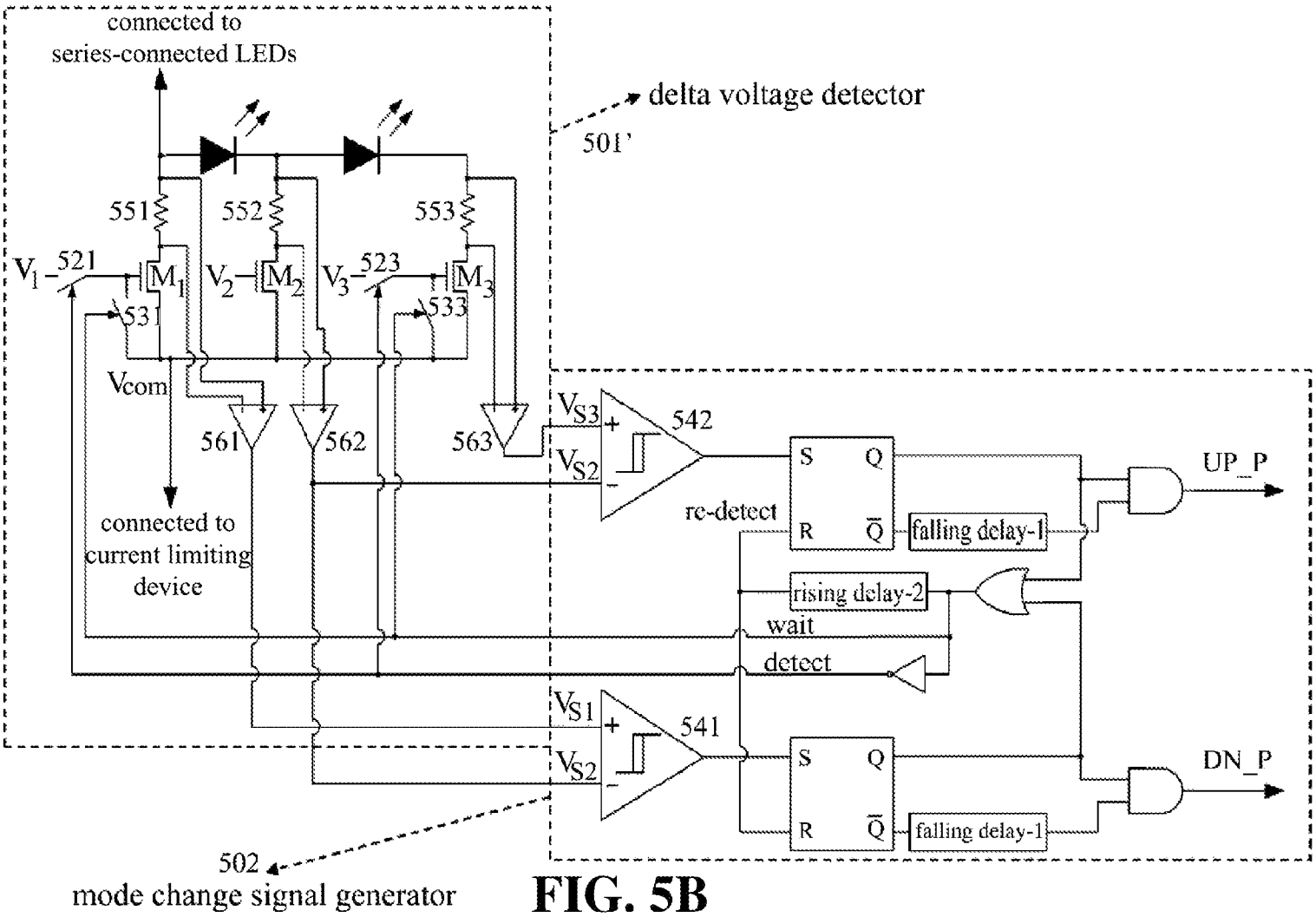
FIG. 5B shows the block diagram of a second implementation of the switching voltage detector in the first preferred embodiment.

In accordance with the present invention, FIG. 5B illustrates a second implementation of the switching voltage detector 130 in the first preferred embodiment. In the second implementation, the delta voltage detector 501' also comprises three N-type voltage controlled current limiting devices $M_1$, $M_2$ and $M_3$. The first ends of three current sensing devices 551, 552 and 553 are connected respectively to the first terminals of the three N-type voltage controlled current limiting devices $M_1$, $M_2$ and $M_3$. One or more LEDs are connected in series between the second ends of two adjacent current sensing devices.

In the second implementation, the second terminals of the three N-type voltage controlled current limiting devices are connected to three bias voltages $V_1$, $V_2$ and $V_3$ respectively similar to the first implementation. The third terminal of each N-type voltage controlled current limiting device is connected directly to the common node. There are three differential amplifiers 561, 562 and 563 connected respectively across the second and first ends of the current sensing device 551, 552 and 553.

As shown in FIG. 5B, the first comparator 541 receives the outputs of the differential amplifiers 561 and 562, and the second comparator 542 receives the outputs of the differential amplifiers 563 and 562. The mode change signal generator 502 in the second implementation illustrated in FIG. 5B is identical to that of the first implementation illustrated in FIG. 5A. The working principle of delta voltage detector 501' in FIG. 5B is also similar to the first implementation and will not be repeated.

Figure 8:
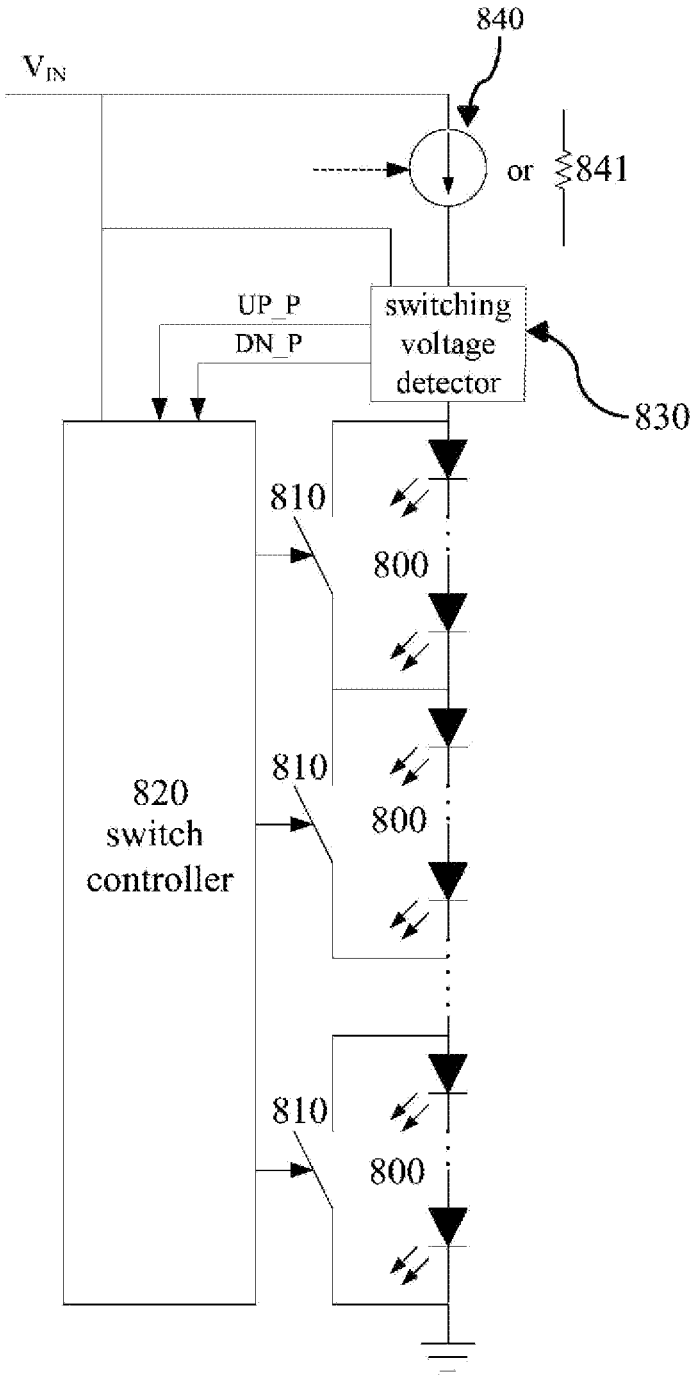
FIG. 8 shows a block diagram of an apparatus for driving LEDs using high voltage according to a second preferred embodiment of the present invention.

FIG. 8 shows a block diagram of an apparatus for driving LEDs using high voltage according to a second preferred embodiment of the present invention. In the embodiment, the apparatus also comprises a plurality of LEDs connected in series. The plurality of LEDs is divided into a plurality of LED segments 800. Each LED segment 800 has a positive end and a negative end connected respectively to the negative end of its preceding LED segment and the positive end of its following LED segment.

As can be seen in FIG. 8, each LED segment 800 has a switching device 810 connected in parallel with the LED segment 800. A switch controller 820 provides a plurality of switching signals to control the plurality of switching devices 810. In the second preferred embodiment, the negative end of the trailing LED segment is connected to ground.

An input high voltage $V_{IN}$ supplies the voltage to the apparatus for driving the LEDs. A current limiting device 840 is connected between the input voltage $V_{IN}$ and a switching voltage detector 830 that detects the voltage level of the input voltage $V_{IN}$ and generates two mode change signals UP_P and DNP to control the switch controller 820. The current limiting device may be replaced by a resistor 841.

As the input voltage $V_{IN}$ increases, the mode change signal UP_P generates a series of mode change pulses to change the state of the switch controller 820. Similarly, as the input voltage $V_{IN}$ decreases, the mode change signal DN_P generates a series of mode change pulses to change the state of the switch controller 820.

In the present invention, the switch controller 120 for the first preferred embodiment can also be used as the switch controller 820 in the second preferred embodiment. Similar to the first preferred embodiment, the switch controller 820 may generate binary codes by using a ripple counter, or generate non-binary codes by using a ripple counter in association with a code mapping memory device.

Figure 9A:
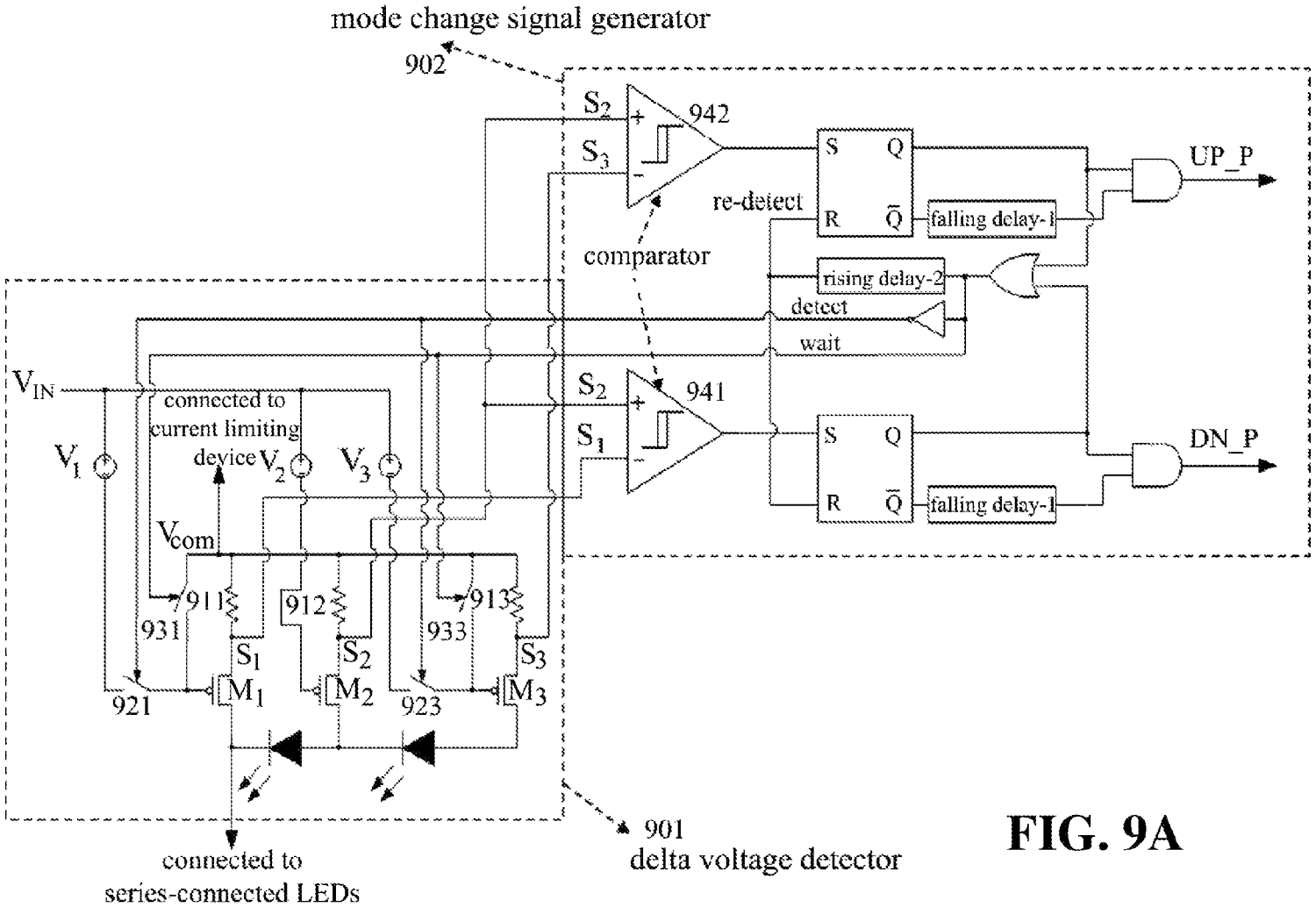
FIG. 9A shows the block diagram of a first implementation of the switching voltage detector in the second preferred embodiment.

In the second preferred embodiment, the switching voltage detector 830 comprises a delta voltage detector 901 and a mode change signal generator 902 as shown in a first implementation illustrated in FIG. 9A. The delta voltage detector 901 includes three P-type voltage controlled current limiting devices $M_1$, $M_2$ and $M_3$. Each of the P-type voltage controlled current limiting devices has three terminals. One or more LEDs are connected in series between the first terminals of $M_1$ and $M_2$. Similarly, one or more LEDs are connected in series between the first terminals of $M_2$ and $M_3$.

Although FIG. 9A shows three P-channel Metal Oxide Semiconductor (PMOS) field effect transistors as $M_1$, $M_2$ and $M_3$, PNP Bipolar Junction Transistor (BJT) and P-channel Insulated Gate Bipolar Transistor (IGBT) can also be used as the P-type voltage controlled current limiting devices.

Figure 10:
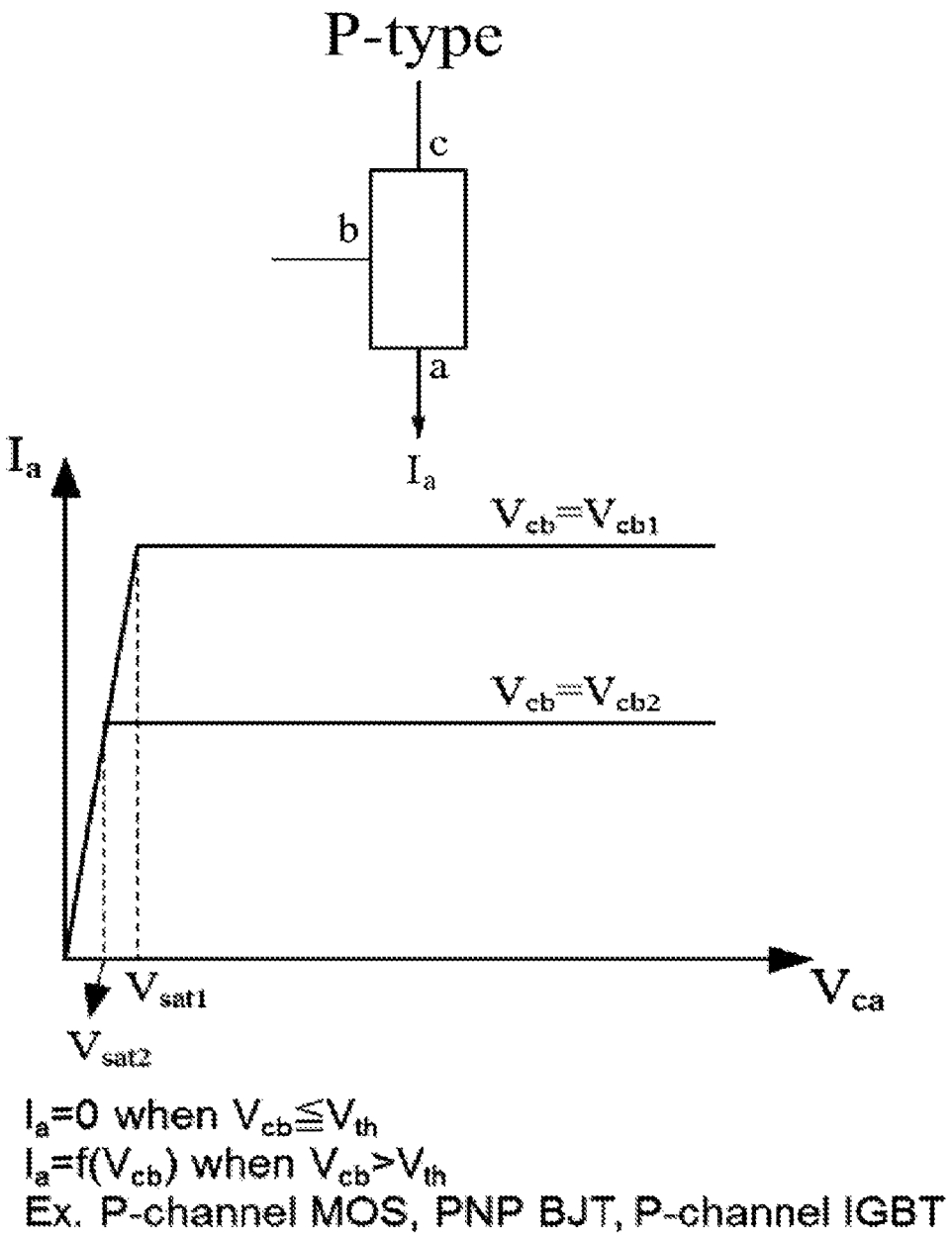
FIG. 10 shows the I-V characteristics of the P-type three-terminal voltage controlled current limiting device used in the delta voltage detector of the switching voltage detector in the second preferred embodiment.

FIG. 10 shows the I-V characteristics of the P-type three-terminal voltage controlled current limiting device according to the present invention. When the voltage $V_{cb}$ across the third and second terminals (terminals c and b) is less than or equal to the threshold voltage $V_{th}$ of the P-type three-terminal voltage controlled current limiting device, the current limiting device is cut off and the current $I_a$ flowing through the current limiting device is zero.

When the voltage $V_{cb}$ is greater than the threshold voltage $V_{th}$, and the voltage $V_{ca}$ across the third and first terminals (terminals c and a) is less than a saturation voltage $V_{sat}$ of the P-type three-terminal voltage controlled current limiting device, the current limiting device behaves like a resistor. In other words, $I_a$ is linearly proportional to $V_{ca}$.

As can be seen from FIG. 10, when the voltage $V_{cb}$ is greater than the threshold voltage $V_{th}$, and the voltage $V_{ca}$ across terminals c and a is greater than the saturation voltage $V_{sat}$, the P-type three-terminal voltage controlled current limiting device becomes a constant current source and $I_a$ is a function of $V_{cb}$, i.e. $I_a=f(V_{cb})$. It can also be noted that the saturation voltage $V_{sat}$ is proportional to $V_{cb}$.

As shown in FIG. 9A, three voltage sources $V_1$, $V_2$ and $V_3$ are respectively connected between the input voltage $V_{IN}$ and the second terminals of the three P-type voltage controlled current limiting devices. The preferred voltages are $V_1<V_2<V_3$ when $M_1$, $M_2$ and $M_3$ have identical characteristics. The third terminals of $M_1$, $M_2$ and $M_3$ are connected to a common node through three respective current sensing devices 911, 912 and 913.

It can be seen in FIG. 9A that the connection to the voltage sources $V_1$ and $V_3$ for $M_1$ and $M_3$ are controlled by the bias voltage switching devices 921 and 923 respectively. Furthermore, the bias voltages applied to the second terminals of the three PMOSs in this embodiment are the voltage differences between the input voltage $V_{IN}$ and the voltage sources $V_1$, $V_2$ and $V_3$ respectively.

Similar to the first preferred embodiment, the P-type three-terminal voltage controlled current limiting devices $M_1$ and $M_3$ in the second preferred embodiment also have by-pass switching devices 931 and 933 connected between their respective second terminals and the common node.

In the mode change signal generator 902, a first comparator 941 has two inputs respectively connected to the current sensing devices 912 and 911. A second comparator 942 has two inputs respectively connected to the current sensing devices 912 and 913. As shown in FIG. 9A, the mode change signal generator 902 also includes a control signal generator formed by two RS flip-flops, three delay circuits and a few logic gates for generating the wait signal, detect signal, and the two mode change signals UP_P and DN_P.

Figure 11:
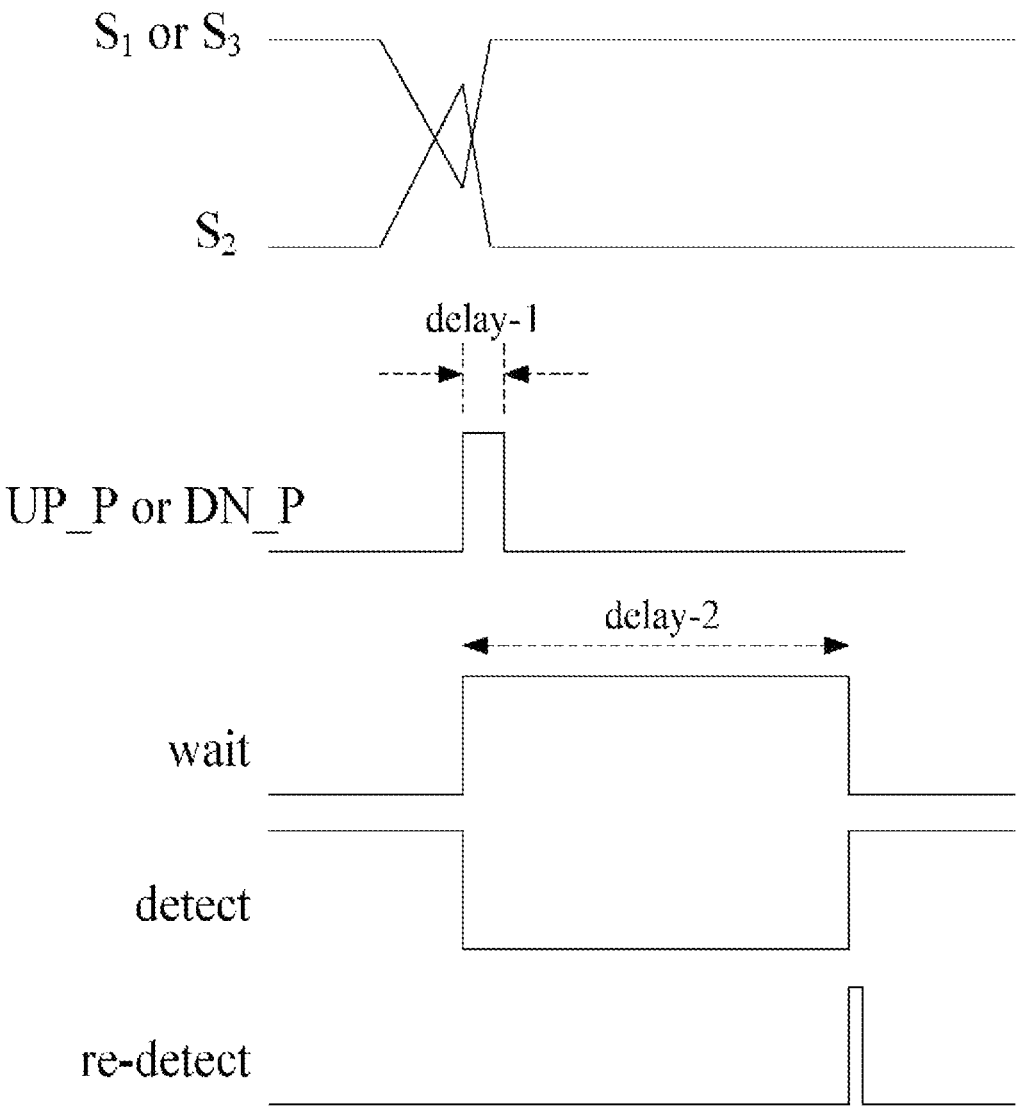
FIG. 11 illustrates the signal waveforms for various signals in the mode change signal generator of the second preferred embodiment.

A person of ordinary skill in the art should already realize that the working principles of the delta voltage detector 901 and the mode change signal generator 902 in the second preferred embodiment are very similar to that of the delta voltage detector 501 and the mode change signal detector 502 in the first preferred embodiment, and therefore will not be described here. FIG. 11 illustrates the signal waveforms for various signals in the mode change signal generator 902.

Figure 9B:
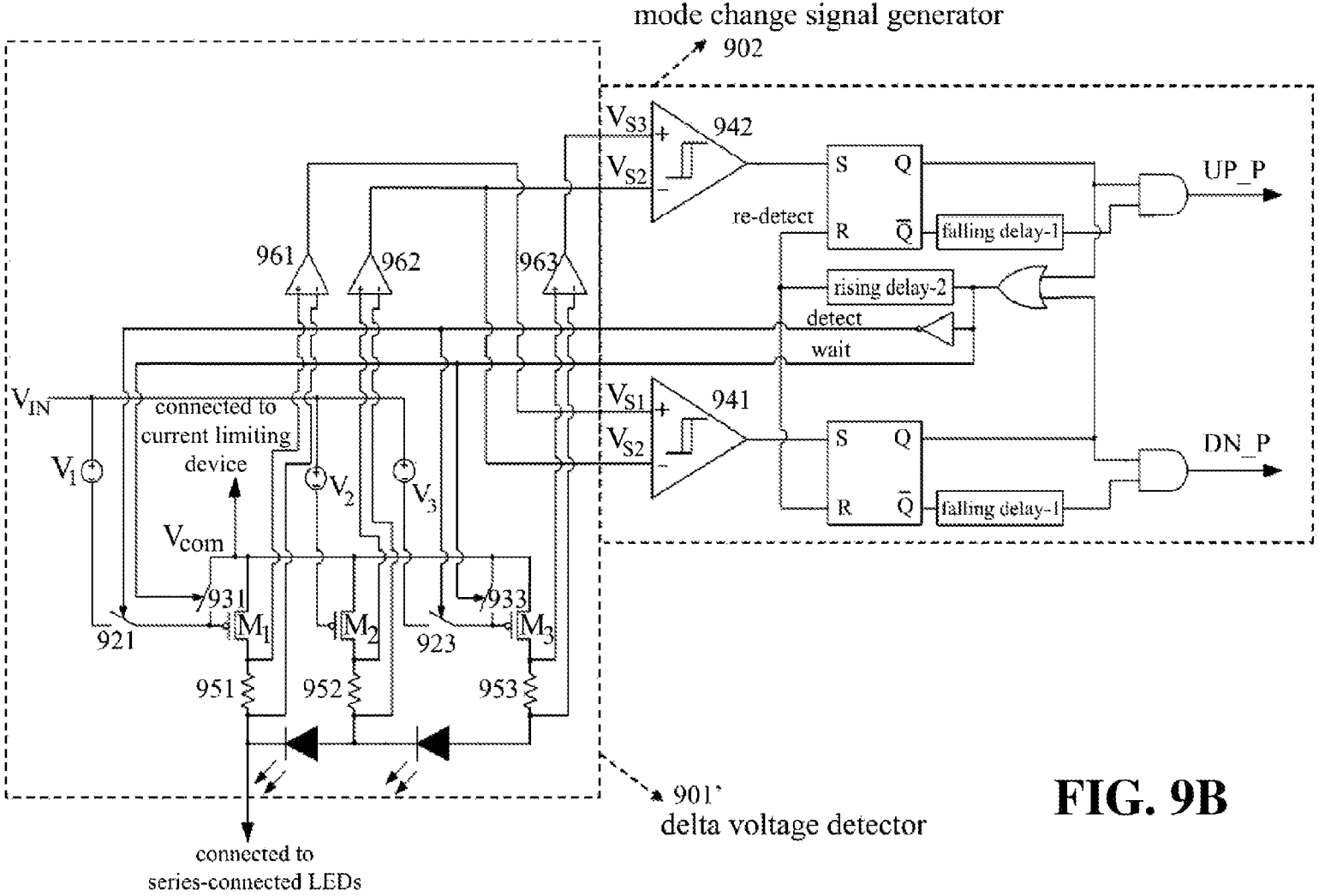
FIG. 9B shows the block diagram of a second implementation of the switching voltage detector in the second preferred embodiment.

In accordance with the present invention, FIG. 9B illustrates a second implementation of the switching voltage detector 830 in the second preferred embodiment. In the second implementation, the delta voltage detector 901' also comprises three P-type voltage controlled current limiting devices $M_1$, $M_2$ and $M_3$. The third terminal of each P-type voltage controlled current limiting device is connected directly to the common node. Three voltage sources $V_1$, $V_2$ and $V_3$ are respectively connected between the input voltage $V_{IN}$ and the second terminals of the three P-type voltage controlled current limiting devices similar to the first implementation.

In the second implementation, the first ends of three current sensing devices 951, 952 and 953 are connected respectively to the first terminals of the three P-type voltage controlled current limiting devices $M_1$, $M_2$ and $M_3$. One or more LEDs are connected in series between the second ends of two adjacent current sensing devices. There are three differential amplifiers 961, 962 and 963 connected respectively across the first and second ends of the current sensing device 951, 952 and 953.

As shown in FIG. 9B, the first comparator 941 receives the outputs of the differential amplifiers 961 and 962, and the second comparator 942 receives the outputs of the differential amplifiers 963 and 962. The mode change signal generator 902 in the second implementation illustrated in FIG. 9B is identical to that of the first implementation illustrated in FIG. 9A. The working principle of the delta voltage detector 901' in FIG. 9B is also similar to the first implementation and will not be described.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An apparatus for driving a plurality of LEDs, comprising:

a plurality of LEDs divided into a plurality of LED segments connected in series, each of said plurality LED segments having a positive end and a negative end, and a switching device connected in parallel between the positive and negative ends;

an input voltage connected to the positive end of a leading LED segment of said plurality of LED segments;

a switching voltage detector having a first end connected to the negative end of a trailing LED segment of said plurality of LED segments, and generating a first mode change signal when said input voltage increases and a second mode change signal when said input voltage decreases;

a current limiting device having a first end connected to a second end of said switching voltage detector and a second end connected to ground; and a switch controller receiving said input voltage and said first and second mode change signals and generating a plurality of switching control signals for respectively controlling the switching devices of said plurality of LED segments;

wherein said switching voltage detector includes a delta voltage detector, said delta voltage detector comprising:

a first voltage controlled current limiting device having a first terminal, a second terminal connected to a first bias voltage through a bias voltage switching device, a third terminal connected to a common node through a first current sensing device, and a by-pass switching device connected between said second terminal and said common node, said first terminal and said common node being connected respectively to the first end and the second end of said switching voltage detector;

a second voltage controlled current limiting device having a first terminal, a second terminal connected to a second bias voltage and a third terminal connected to said common node through a second current sensing device;

a third voltage controlled current limiting device having a first terminal, a second terminal connected to a third bias voltage through a bias voltage switching device, a third terminal connected to said common node through a third current sensing device, and a by-pass switching device connected between the second terminal of said third voltage controlled current limiting device and said common node;

one or more LEDs connected in series between the first terminals of said first and second voltage controlled current limiting devices; and one or more LEDs connected in series between the first terminals of said second and third voltage controlled current limiting devices.

2. The apparatus as claimed in claim 1, wherein said current limiting device is a resistor.

3. The apparatus as claimed in claim 1, wherein said switching voltage detector further comprises a mode change signal generator, said mode change signal generator comprising:

a first comparator having a first input connected to the third terminal of said first voltage controlled current limiting device and a second input connected to the third terminal of said second voltage controlled current limiting device, and generating a first comparator output;

a second comparator having a first input connected to the third terminal of said third voltage controlled current limiting device and a second input connected to the third terminal of said second voltage controlled current limiting device, and generating a second comparator output; and a control signal generator receiving said first and second comparator outputs and generating said first and second mode change signals;

wherein the first terminal of said first voltage controlled current limiting device is connected to the negative end of said trailing LED segment, said common node is connected to the first end of said current limiting device of said apparatus, and said mode change signal generator generates a wait signal to control the two by-pass switching devices in said delta voltage detector, and a detect signal to control the two bias voltage switching devices in said delta voltage detector.

4. The apparatus as claimed in claim 3, wherein said switch controller further comprises:

a ripple counter receiving said first and second mode change signals and generating a plurality of counter outputs; and a plurality of switch drivers receiving said plurality of counter outputs and generating said plurality of switching control signals;

wherein said plurality of counter outputs are binary codes.

5. The apparatus as claimed in claim 3, wherein said switch controller further comprises:

a ripple counter receiving said first and second mode change signals and generating a first plurality of outputs;

a memory device receiving said first plurality of outputs and mapping said first plurality of outputs into a second plurality of outputs; and a plurality of switch drivers receiving said second plurality of outputs and generating said plurality of switching control signals;

wherein said first plurality of outputs are binary codes and said second plurality of outputs are non-binary codes.

6. The apparatus as claimed in claim 3, wherein each of said first, second and third voltage controlled current limiting devices is an N-channel metal oxide semiconductor field effect transistor, an NPN bipolar junction transistor, or an N-channel insulated gate bipolar transistor.

7. An apparatus for driving a plurality of LEDs, comprising:

a plurality of LEDs divided into a plurality of LED segments connected in series, each of said plurality LED segments having a positive end and a negative end, and a switching device connected in parallel between the positive and negative ends;

an input voltage connected to the positive end of a leading LED segment of said plurality of LED segments;

a switching voltage detector having a first end connected to the negative end of a trailing LED segment of said plurality of LED segments, and generating a first mode change signal when said input voltage increases and a second mode change signal when said input voltage decreases;

a current limiting device having a first end connected to a second end of said switching voltage detector and a second end connected to ground;

a switch controller receiving said input voltage and said first and second mode change signals and generating a plurality of switching control signals for respectively controlling the switching devices of said plurality of LED segments;

wherein said switch controller further comprises:

a ripple counter receiving said first and second mode change signals and generating a plurality of counter outputs; and a plurality of switch drivers receiving said plurality of counter outputs and generating said plurality of switching control signals;

wherein said plurality of counter outputs are binary codes.

8. An apparatus for driving a plurality of LEDs, comprising:

a plurality of LEDs divided into a plurality of LED segments connected in series, each of said plurality LED segments having a positive end and a negative end, and a switching device connected in parallel between the positive and negative ends;

an input voltage connected to the positive end of a leading LED segment of said plurality of LED segments;

a switching voltage detector having a first end connected to the negative end of a trailing LED segment of said plurality of LED segments, and generating a first mode change signal when said input voltage increases and a second mode change signal when said input voltage decreases;

a current limiting device having a first end connected to a second end of said switching voltage detector and a second end connected to ground;

a switch controller receiving said input voltage and said first and second mode change signals and generating a plurality of switching control signals for respectively controlling the switching devices of said plurality of LED segments;

wherein said switch controller further comprises:

a ripple counter receiving said first and second mode change signals and generating a first plurality of outputs;

a memory device receiving said first plurality of outputs and mapping said first plurality of outputs into a second plurality of outputs; and a plurality of switch drivers receiving said second plurality of outputs and generating said plurality of switching control signals;

wherein said first plurality of outputs are binary codes and said second plurality of outputs are non-binary codes.

9. An apparatus for driving a plurality of LEDs, comprising:

a plurality of LEDs divided into a plurality of LED segments connected in series, each of said plurality LED segments having a positive end and a negative end, and a switching device connected in parallel between the positive and negative ends;

an input voltage connected to the positive end of a leading LED segment of said plurality of LED segments;

a switching voltage detector having a first end connected to the negative end of a trailing LED segment of said plurality of LED segments, and generating a first mode change signal when said input voltage increases and a second mode change signal when said input voltage decreases;

a current limiting device having a first end connected to a second end of said switching voltage detector and a second end connected to ground;

a switch controller receiving said input voltage and said first and second mode change signals and generating a plurality of switching control signals for respectively controlling the switching devices of said plurality of LED segments;

wherein said switching voltage detector further comprises a delta voltage detector and a mode change signal generator, said delta voltage detector comprising:

a first voltage controlled current limiting device having a first terminal connected to a first end of a first current sensing device, a second terminal connected to a first bias voltage through a bias voltage switching device, a third terminal connected to a common node, and a by-pass switching device connected between said second terminal and said common node;

a second voltage controlled current limiting device having a first terminal connected to a first end of a second current sensing device, a second terminal connected to a second bias voltage and a third terminal connected to said common node;

a third voltage controlled current limiting device having a first terminal connected to a first end of a third current sensing device, a second terminal connected to a third bias voltage through a bias voltage switching device, a third terminal connected to said common node, and a by-pass switching device connected between the second terminal of said third voltage controlled current limiting device and said common node;

a first differential amplifier having two inputs connected respectively to the second end and a first end of said first current sensing device;

a second differential amplifier having two inputs connected respectively to the second end and a first end of said second current sensing device;

a third differential amplifier having two inputs connected respectively to the second end and a first end of said third current sensing device;

one or more LEDs connected in series between the second ends of said first and second current sensing devices; and one or more LEDs connected in series between the second ends of said second and third current sensing devices;

and said mode change signal generator comprising:

a first comparator having a first input connected to an output of said first differential amplifier and a second input connected to an output of said second differential amplifier, and generating a first comparator output;

a second comparator having a first input connected to an output of said third differential amplifier and a second input connected to an output of said second differential amplifier, and generating a second comparator output; and a control signal generator receiving said first and second comparator outputs and generating said first and second mode change signals;

wherein the second end of said first current sensing device is connected to the negative end of said trailing LED segment, said common node is connected to the first end of said current limiting device of said apparatus, and said mode change signal generator generates a wait signal to control the two by-pass switching devices in said delta voltage detector, and a detect signal to control the two bias voltage switching devices in said delta voltage detector.

10. The apparatus as claimed in claim 9, wherein each of said first, second and third voltage controlled current limiting devices is an N-channel metal oxide semiconductor field effect transistor, an NPN bipolar junction transistor, or an N-channel insulated gate bipolar transistor.

11. An apparatus for driving a plurality of LEDs, comprising:

an input voltage;

a plurality of LEDs divided into a plurality of LED segments connected in series, each of said plurality LED segments having a positive end and a negative end, and a switching device connected in parallel between the positive and negative ends;

a current limiting device having a first end connected to said input voltage and a second end;

a switching voltage detector receiving said input voltage and having a first end connected to said second end of said current limiting device and a second end connected to the positive end of a leading LED segment of said plurality of LED segments, and generating a first mode change signal when said input voltage increases and a second mode change signal when said input voltage decreases; and a switch controller receiving said input voltage and said first and second mode change signals and generating a plurality of switching control signals for respectively controlling the switching devices of said plurality of LED segments;

wherein the negative end of a trailing LED segment of said plurality of LED segments is connected to ground, and said switching voltage detector comprises a delta voltage detector, said delta voltage detector comprising:

a first voltage controlled current limiting device having a first terminal, a second terminal connected to a first voltage source through a bias voltage switching device, a third terminal connected to a common node through a first current sensing device, and a by-pass switching device connected between said second terminal and said common node, said first voltage source being connected between said input voltage and said bias voltage switching device, said common node and said first terminal being connected respectively to the first end and the second end of said switching voltage detector;

a second voltage controlled current limiting device having a first terminal, a second terminal connected to a second voltage source and a third terminal connected to said common node through a second current sensing device, said second voltage source being connected between said input voltage and the second terminal of said second voltage controlled current limiting device; and a third voltage controlled current limiting device having a first terminal, a second terminal connected to a third voltage source through a bias voltage switching device, a third terminal connected to said common node through a third current sensing device, and a by-pass switching device connected between the second terminal of said third voltage controlled current limiting device and said common node, said third voltage source being connected between said input voltage and the bias voltage switching device of said third voltage controlled current limiting device;

one or more LEDs connected in series between the first terminals of said first and second voltage controlled current limiting devices; and one or more LEDs connected in series between the first terminals of said second and third voltage controlled current limiting devices.

12. The apparatus as claimed in claim 11, wherein said current limiting device is a resistor.

13. The apparatus as claimed in claim 11, wherein said switching voltage detector further comprises a mode change signal generator, said mode change signal generator comprising:

a first comparator having a first input connected to the third terminal of said second voltage controlled current limiting device and a second input connected to the third terminal of said first voltage controlled current limiting device, and generating a first comparator output;

a second comparator having a first input connected to the third terminal of said second voltage controlled current limiting device and a second input connected to the third terminal of said third voltage controlled current limiting device, and generating a second comparator output; and a control signal generator receiving said first and second comparator outputs and generating said first and second mode change signals;

wherein the first terminal of said first voltage controlled current limiting device is connected to the positive end of said leading LED segment, said common node is connected to the second end of said current limiting device of said apparatus, and said mode change signal generator generates a wait signal to control the two by-pass switching devices in said delta voltage detector, and a detect signal to control the two bias voltage switching devices in said delta voltage detector.

14. The apparatus as claimed in claim 13, wherein said switch controller further comprises:

a ripple counter receiving said first and second mode change signals and generating a plurality of counter outputs; and a plurality of switch drivers receiving said plurality of counter outputs and generating said plurality of switching control signals;

wherein said plurality of counter outputs are binary codes.

15. The apparatus as claimed in claim 13, wherein said switch controller further comprises:

a ripple counter receiving said first and second mode change signals and generating a first plurality of outputs;

a memory device receiving said first plurality of outputs and mapping said first plurality of outputs into a second plurality of outputs; and a plurality of switch drivers receiving said second plurality of outputs and generating said plurality of switching control signals;

wherein said first plurality of outputs are binary codes and said second plurality of outputs are non-binary codes.

16. The apparatus as claimed in claim 13, wherein each of said first, second and third voltage controlled current limiting devices is a P-channel metal oxide semiconductor field effect transistor, a PNP bipolar junction transistor, or a P-channel insulated gate bipolar transistor.

17. An apparatus for driving a plurality of LEDs, comprising:

an input voltage;

a plurality of LEDs divided into a plurality of LED segments connected in series, each of said plurality LED segments having a positive end and a negative end, and a switching device connected in parallel between the positive and negative ends;

a current limiting device having a first end connected to said input voltage and a second end;

a switching voltage detector receiving said input voltage and having a first end connected to said second end of said current limiting device and a second end connected to the positive end of a leading LED segment of said plurality of LED segments, and generating a first mode change signal when said input voltage increases and a second mode change signal when said input voltage decreases; and a switch controller receiving said input voltage and said first and second mode change signals and generating a plurality of switching control signals for respectively controlling the switching devices of said plurality of LED segments;

wherein the negative end of a trailing LED segment of said plurality of LED segments is connected to ground, and said switch controller further comprises:

a ripple counter receiving said first and second mode change signals and generating a plurality of counter outputs; and a plurality of switch drivers receiving said plurality of counter outputs and generating said plurality of switching control signals;

wherein said plurality of counter outputs are binary codes.

18. An apparatus for driving a plurality of LEDs, comprising:

an input voltage;

a plurality of LEDs divided into a plurality of LED segments connected in series, each of said plurality LED segments having a positive end and a negative end, and a switching device connected in parallel between the positive and negative ends;

a current limiting device having a first end connected to said input voltage and a second end;

a switching voltage detector receiving said input voltage and having a first end connected to said second end of said current limiting device and a second end connected to the positive end of a leading LED segment of said plurality of LED segments, and generating a first mode change signal when said input voltage increases and a second mode change signal when said input voltage decreases; and a switch controller receiving said input voltage and said first and second mode change signals and generating a plurality of switching control signals for respectively controlling the switching devices of said plurality of LED segments;

wherein the negative end of a trailing LED segment of said plurality of LED segments is connected to ground, and said switch controller further comprises:

a ripple counter receiving said first and second mode change signals and generating a first plurality of outputs;

a memory device receiving said first plurality of outputs and mapping said first plurality of outputs into a second plurality of outputs; and a plurality of switch drivers receiving said second plurality of outputs and generating said plurality of switching control signals;

wherein said first plurality of outputs are binary codes and said second plurality of outputs are non-binary codes.

19. An apparatus for driving a plurality of LEDs, comprising:

an input voltage;

a plurality of LEDs divided into a plurality of LED segments connected in series, each of said plurality LED segments having a positive end and a negative end, and a switching device connected in parallel between the positive and negative ends;

a current limiting device having a first end connected to said input voltage and a second end;

a switching voltage detector receiving said input voltage and having a first end connected to said second end of said current limiting device and a second end connected to the positive end of a leading LED segment of said plurality of LED segments, and generating a first mode change signal when said input voltage increases and a second mode change signal when said input voltage decreases; and a switch controller receiving said input voltage and said first and second mode change signals and generating a plurality of switching control signals for respectively controlling the switching devices of said plurality of LED segments;

wherein the negative end of a trailing LED segment of said plurality of LED segments is connected to ground, and said switching voltage detector further comprises a delta voltage detector and a mode change signal generator, said delta voltage detector comprising:

a first voltage controlled current limiting device having a first terminal connected to a first end of a first current sensing device, a second terminal connected to a first voltage source through a bias voltage switching device, a third terminal connected to a common node, and a by-pass switching device connected between said second terminal and said common node, said first voltage source being connected between said input voltage and said bias voltage switching device;

a second voltage controlled current limiting device having a first terminal connected to a first end of a second current sensing device, a second terminal connected to a second voltage source and a third terminal connected to said common node, said second voltage source being connected between said input voltage and the second terminal of said second voltage controlled current limiting device;

a third voltage controlled current limiting device having a first terminal connected to a first end of a third current sensing device, a second terminal connected to a third voltage source through a bias voltage switching device, a third terminal connected to said common node, and a by-pass switching device connected between the second terminal of said third voltage controlled current limiting device and said common node, said third voltage source being connected between said input voltage and the bias voltage switching device of said third voltage controlled current limiting device;

a first differential amplifier having two inputs connected respectively to the first end and a second end of said first current sensing device;

a second differential amplifier having two inputs connected respectively to the first end and a second end of said second current sensing device;

a third differential amplifier having two inputs connected respectively to the first end and a second end of said third current sensing device;

one or more LEDs connected in series between the second ends of said first and second current sensing devices; and one or more LEDs connected in series between the second ends of said second and third current sensing devices;

and said mode change signal generator comprising:

a first comparator having a first input connected to an output of said first differential amplifier and a second input connected to an output of said second differential amplifier, and generating a first comparator output;

a second comparator having a first input connected to an output of said third differential amplifier and a second input connected to an output of said second differential amplifier, and generating a second comparator output; and a control signal generator receiving said first and second comparator outputs and generating said first and second mode change signals;

wherein the second end of said first current sensing device is connected to the positive end of said leading LED segment, said common node is connected to the second end of said current limiting device of said apparatus, and said mode change signal generator generates a wait signal to control the two by-pass switching devices in said delta voltage detector, and a detect signal to control the two bias voltage switching devices in said delta voltage detector.

20. The apparatus as claimed in claim 19, wherein each of said first, second and third voltage controlled current limiting devices is a P-channel metal oxide semiconductor field effect transistor, a PNP bipolar junction transistor, or a P-channel insulated gate bipolar transistor.

* * * * *